United States Patent [19]

Kiefer

[11] 3,986,223

[45] Oct. 19, 1976

[54] SURFACE CLEANING DEVICE

[75] Inventor: Richard J. Kiefer, Garden City Park, N.Y.

[73] Assignee: Herbert Products, Inc., Westbury, N.Y.

[22] Filed: Feb. 13, 1975

[21] Appl. No.: 549,704

Related U.S. Application Data

[63] Continuation-in-part of Ser. No. 362,552, May 21, 1973, abandoned.

[52] U.S. Cl. ..... 15/1.5 R; 15/309

[51] Int. Cl.[2] ..... A47L 13/40

[58] Field of Search ..... 15/306 A, 308, 309, 15/1.5

[56] References Cited

UNITED STATES PATENTS

| | | | |
|---|---|---|---|
| 3,097,971 | 7/1963 | Carlisle et al. | 15/306 A X |
| 3,128,492 | 4/1964 | Hanscom et al. | 15/308 |
| 3,395,042 | 7/1968 | Herbert | 15/308 X |
| 3,470,576 | 10/1969 | Troia | 15/308 |

*Primary Examiner*—Christopher K. Moore

*Attorney, Agent, or Firm*—Bauer, Amer & King

[57] ABSTRACT

A device to remove surface particulates from fed materials, as paper and the like, wherein a reduced pressure is applied in a housing to effect a pressure gradient across the fed material to distort and conform the same to a substantial peripheral portion of a brush rotating in the housing to provide an area of surface cleaning engagement between the brush and the fed material to thereby produce an effective and efficient cleaning action.

17 Claims, 4 Drawing Figures

SURFACE CLEANING DEVICE

This application is a continuation-in-part of co-pending application Ser. No. 362,552, filed May 21, 1973, now abandoned.

This invention relates to an appliance for cleaning fed material of any kind. The invention may be described more readily and easily with respect to a cleaning device for feed stock on a printing machine that cleans by concomitant application of electrostatic, vacuum and abrasive action.

More particularly, surface dirt is a problem to the printing industry. As the feed stock is printed, any particulates on the surface thereof blocks application of the printing or wetting medium to the same. Quite obviously then, the deposition of surface dirt produces voids on the stock when they later fall or flake off, if not also smearing or otherwise ruining the work piece.

On the microscopic level, removal of surface particulates such as dust, pollen, dirt, etc. appears deceptively to be a simple chore. Yet in practice, efficient removal of these particulates eludes the industry, in part because of interaction between the paticulates and the feed stock on the microscopic level.

Under the scanning electron microscope, even the smoothest of papers or fabric is a composite of interengaging fibers and molecular threads. Hence, the work surface readily "catches" the periphery of the deposited particulate making difficult its removal therefrom. The feed stock's affinity for dust is further enhanced by the perimetric texture of the particle which itself is most often other than smooth and more usually barb-like.

Then, too, the feed stock or work piece is most often an insulator electrically. Hence, their surfaces will retain localized electric charge giving rise to an accelerating potential that attracts the particulates. Their electrostatic force further adds to the tenacity or adherence of the surface particulate to the work piece.

Compounding the problem of surface removal of dirt is the environment in which the cleaning must be effected. This environment requires that the feed stock move at a rapid rate mandating that the cleaning station be fast acting and efficient. Further, as was pointed out, although the work piece may be of any fed material, it most often is a web of paper or cloth. As such, its surface is relatively soft and easily frayed or abraded which properly necessitates a cleaning action which will not destroy the same.

Several prior art constructions relate to paper or surface cleaning apparatus. For example, U.S. Pat. No. 3,395,042 discloses application of a vacuum or area or reduced pressure to the surface of the feed stock, but fails to disclose power operated agitation or brush means to "beat"the stock or web surface and dislodge those particulates that are particularly tenacious.

The teachings of U.S. Pat. No. 2,832,977 relate to a rotary brush and corona discharge device to clean the "toner" or powder from the surface of a xerographic plate or drum, wherein the brush wipes in line engagement with the rigid xerographic surfaces along a tangent line in a negative pressure environment that fails to produce complete and satisfactory removal of particulates from paper and cloth.

It is, therefore, an object of the present invention to provide a device to remove particulates from the surface of feed stock whether the same be discrete sheets or long webs of material.

It is another object of the present invention to provide an appliance to remove surface particulates by concomitant abrasive, vacuum and electrostatic action.

It is a further object of the present invention to provide a cleaning device, particularly suited for application on a moving web or printing sheet that effects a surface cleaning along an area of cleaning engagement conforming to a substantial perimetric portion of a rotating brush.

It is still a further object of the present invention to effect a surface cleaning in a reduced pressure environment whereby the reduced pressure effects a localized distortion of the fed material so that the same conforms to a peripheral portion of a rotary cleaning brush for efficient surface agitation and particulate removal.

It is yet another object of the present invention to provide a cleaning device to remove particulates in a negative pressure environment partially isolated from ambient pressure.

Other objects and features of the present invention will become apparent from the following detailed description considered in connection with the accompanying drawings. It is to be understood that the drawings are designed for purposes of illustration only and not as a definition of the limits of the invention for which reference should be made to the appending claims.

In the drawings, wherein the same reference numeral denotes the same element throughout the several views.

Figure 1:
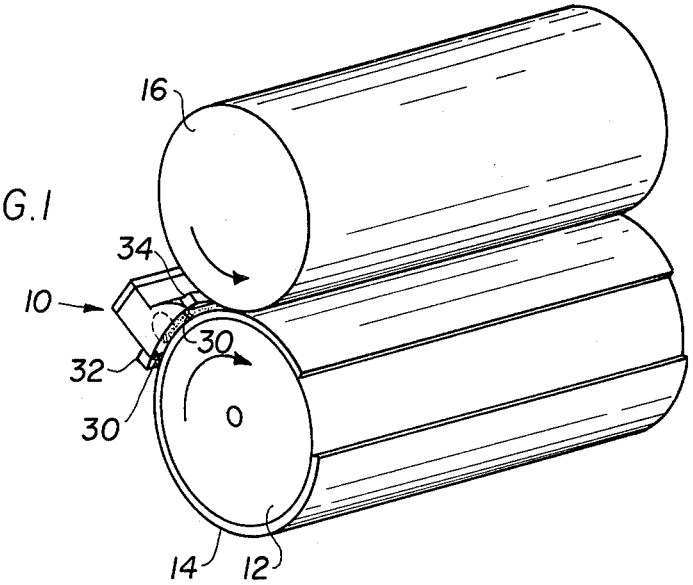
FIG. 1 is a perspective view of the invention device showing the same positioned adjacent a roller of printing machine and cleaning a sheet of paper as it is transported thereby.
Figure 2:
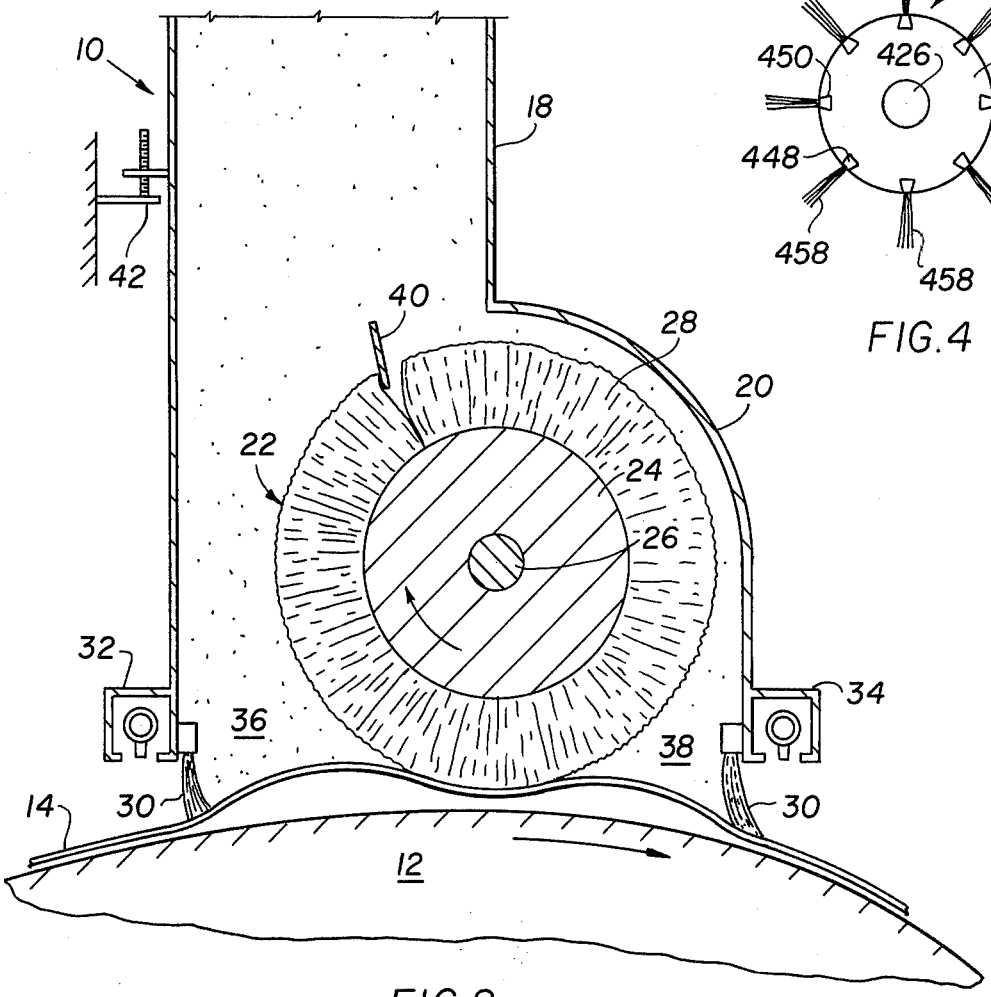
FIG. 2 is an elevational view, in section, of the device of FIG. 1 showing the distortional mode of the fed material about a substantial portion of the roller periphery.

Referring now to FIGS. 1 and 2, there is shown one embodiment of the present invention. The inventive cleaning device, indicated generally by reference numeral 10, is shown contiguous to a transport roller 12. Transport roller 12 carries the feed stock, in this case a sheet of paper 14, into mating engagement with a printing or dampening roller 16. As roller 12 transports paper stock 14 into such mating engagement, stock 14 traverses inventive device 10 that provides a cleaning station or region for the stock surface prior to its contact or engagement with roller 16. As seen in FIG. 1, the cleaning area is coextensive with the longitudinal length of drum 12 and, hence, coextensive to the width of stock 14. Since roller 12 revolves at a relatively high speed, it will be appreciated that stock 14 rides drum 12 on a thin boundary layer of air captured between confronting surfaces of the roller and stock.

Referring now to FIG. 2, there is shown enlarged the cleaning station provided for and shown in perspective in FIG. 1. Appliance 10 includes a housing 18 having an enlarged cowling 20 that opens onto roller 12. Abrasive means, indicated generally by reference numeral 22, is generally of cylindrical shape and in the example shown, is formed of a drum core 24 and driving motor 26. Attached to the periphery of drum 24 is an abrasive covering 28. Preferably, and as shown, covering 28 will comprise a brush-like array of bristles extending radially from the periphery of drum 24. Yet in certain applications in place of bristles 28, it may be advantageous to cover drum 24 with a molleton or pile fabric. Hence, reference to the means 22 as "abrasive" is intended to include a smoothing or polishing function as well as a roughing function.

The abrasive means 22 has a peripheral region thereof extending or projecting from and beyond the leading edge of cowling 20 for efficient broadside area contact with stock 14 during operation of the device as will be described hereinafter.

A pair of opposed curtain or sash means 30 are disposed in straddling relation about the aforesaid extending peripheral region of abrasive means 22. Each curtain means 30 is attached to and carried on the leading edge of cowling 20 and is likewise coextensive with the broadside or longitudinal length of device 10 and hence stock 14. As shown, means 30 projects from cowling 20 into contact with and wiping against stock 14. Means 30 will preferably comprise an array of bristles, but other constructions are suitable such as a synthetic sash formed with perforations or a porous stiffened fabric such as a specially treated felt or pile fabric.

Each one of a pair of corona discharge devices 32 and 34 is attached to cowling 20 at a location outboard of curtains 30 so that the pair straddles abrasive means 22 as shown. Each ion discharge device 32 and 34 is also coextensive with the longitudinal or broadside length of abrasive means 22 and hence material 14. The discharge of ion device 32 is directed onto the surface of web 14 before the same contacts abrasive means 22. And, the discharge of downstream ion device 34 is directed onto the stock or web surface as it leaves device 10 during the operation thereof described hereinafter.

As is apparent from FIG. 2, abrasive means 22 is positioned off-set in relation to housing 18 to thereby provide a primary work zone 36 anterior to the region of contact between stock 14 and means 22. Secondary work zone 38 is posterior to the aforesaid contact region. A slap plate 40 is supported from cowling 20 in interfering relation with bristles 28 so that when arbor 26 drives drum 24, the bristles will slap against or wipe on plate 40 to effect a cleaning thereof as they pass thereby during operation of the device as will now be described.

In operation, a conventional source or negative pressure, not shown, is coupled to housing 18. Driving means common in the art and therefore likewise not shown causes arbor 26 to rotate drum 24 and hence rotatably drive bristles 28. A source of high voltage is applied to each ion device 32 and 34 with the discharge thereof impinging on the surface of stock 14. Housing 18 and integral cowl part 20 is brought into contact with web 14 on drum 12 by adjusting a conventional positioning means 42. As stock 14 passes under ion device 32, the localized electrostatic charge on the surface thereof is neutralized. Application of a negative pressure in housing 18 applies a pressure gradient across stock 14 owing to the relatively higher pressure of the boundary layer extant or captured between the stock and drum 12 when compared to the pressure in the housing and cowling. The pressure differential drives stock 14 against abrasive means 22 causing the stock to distort and conform to a substantial area of the perimetric portion of bristles 28 as shown. The distortional or flexural mode of web 14 increases the swept area of same for a given brush diameter when compared to conventional devices. This increase in swept or contact area enhances the ability of the means 22 to dislodge particulates by subjecting them to increased brush action. The reduced pressure in the housing and cowling is partially localized and isolated from ambient atmosphere by curtain means 30. Of course, means 30 is of sufficient porousity to bleed or admit a substantial amount of ambient air and thus establish an air flow towards the negative pressure means. Further, means 30 enhances the flexural mode induced in stock 14 by tending to provide a reaction point against which it pivots.

Because the primary upstream area 36 is greater than that of the downstream area 38, the suction created thereat against stock 14 causes the same to distort and lift up into fuller engagement with the bristles 28 to a greater extent than in the secondary area 38. This produces an increased cleaning effect at the entrance of the stock to the area 36 immediately after having been subjected to neutralizing ions emitted at the upstream device 32.

It will be observed that the rotation of abrasive means 22 is opposite from the feed direction of stock 14. This contra rotation increases the relative surface agitation on stock 14 as it wipes against bristles 28. The majority of dislodged particulates collect in anterior zone 36 to be transported therefrom in the flow stream established in housing 18 by air bleeding through curtain means 30. To a lesser extent, particulates will collect in posterior chamber area 38 to be likewise removed by the flow stream as the reduced pressure effects their transport accurately along cowling part 18.

Those particulates that lodge or collect in bristles 28 will be driven therefrom by action of the bristles smacking against edge 40. As stock 14 leaves the region of device 10 and exits from under curtain means 30 that is adjacent posterior chamber 38, corona discharge means 34 effects a final neutralization of the surface of the stock. This last neutralization step will discharge any electrostatic potential resulting from action of either abrasive means 22, curtain means 30 or indeed any residual surface charge remaining after the first neutralization afforded by electric discharge device 32.

Figure 3:
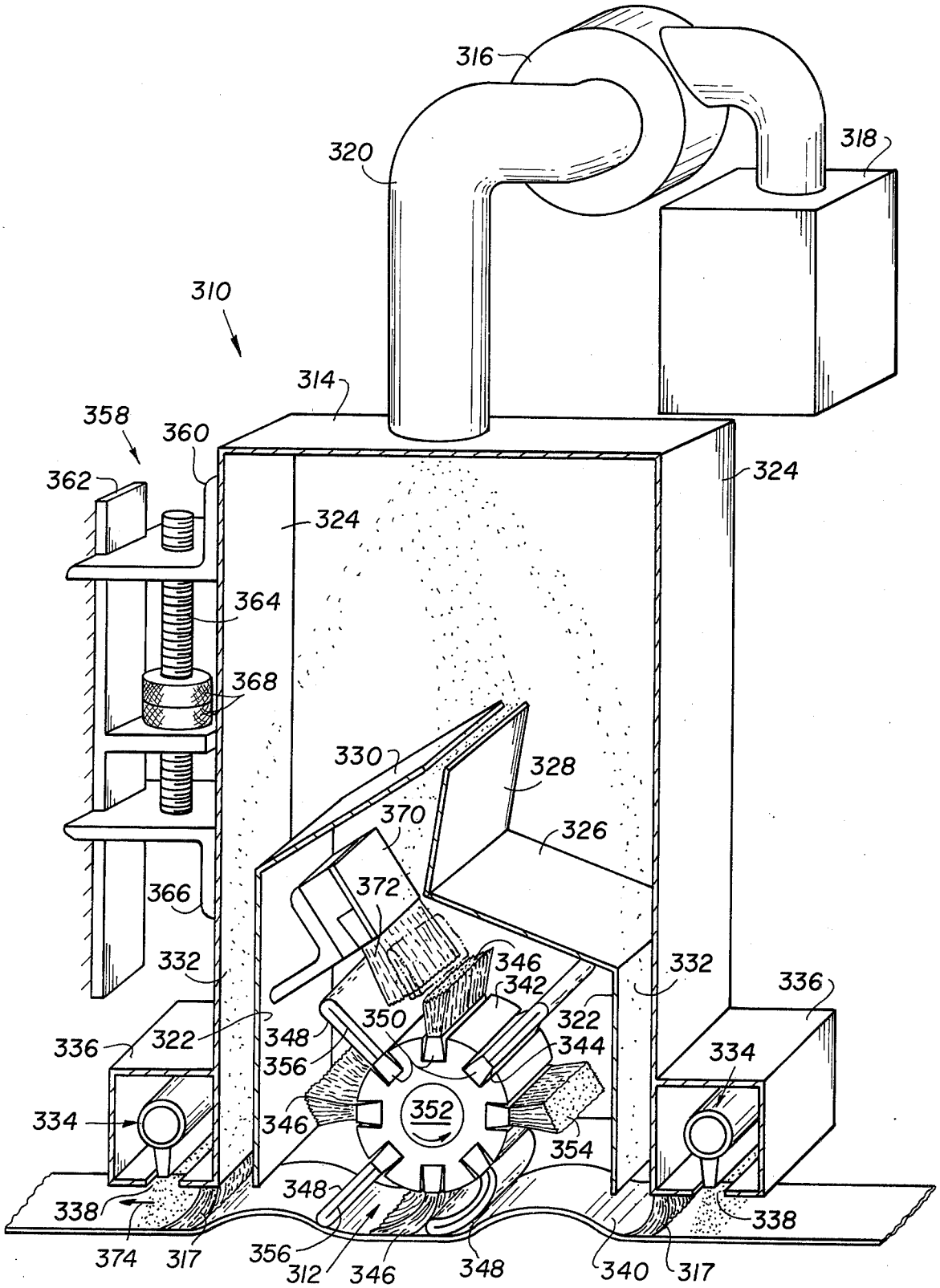
FIG. 3 is a modified form of the present invention similar to that shown in FIG. 2 and including abrasive means formed of alternate discrete packets of bristles and wiping means.

Referring now to FIG. 3, there is shown a modified form of the present invention, the numeral 310 generally identifies a cleaner apparatus in combination with a rotary cleaner therefor. The rotary cleaner is generally identified by the numeral 312 and is positioned between two spaced tension rollers, not shown, that are guiding a continuous web. The apparatus 310 includes an enclosure housing 314 to which there is connected in any convenient manner, such as at the top thereof, a vacuum producing means 316 in the form of a suction motor connected with a dust collecting receptacle 318. The motor 316 is connected with any convenient source of electricity, not shown. The details of the duct work 320 by which the vacuum producing means 316 is connected with the enclosure housing 314 forms no part of the invention. The details illustrated in the drawing merely demonstrate one manner of application of the vacuum producing means to the enclosure 314.

The enclosure 314 is closed about all of its sides except the bottom wherein the same has an opening through which air may be drawn into the chamber as a consequence of the operation of the vacuum producing means 316. A spaced curtain path 317 is attached to the opposed walls of enclosure 314 that are broadside to the web or stock to be cleaned. Each curtain 317 is identical to curtain 30 of FIG. 2 and so is likewise coextensive to the broadside width of the stock against which it wipes. The enclosure 314 is divided by a baffle structure which includes vertical extending walls 322 spaced inward from the outer walls 324 of the enclosure. The walls 322 terminate at their lower ends to define a part of the opening of the total enclosure 314 and at their upper ends are angularly directed to baffle the movement of air down through the opening at the lower portion of the enclosure upwardly toward the duct work 320 by the vacuum producing means 316. Thus, the right-hand wall 322 has a baffle wall 326 that merges with a further baffle diverter 328. The left-hand baffle wall 322 merges with a diverter 330.

Although the diverters 328 and 330 are illustrated as being fixed in position, it is within the contemplation of the invention that they may be pivotable about their respective connections with the walls 322 to variably open and close the space therebetween to thereby enable a variable metering of the flow of air from the lower end or opening of the enclosure 314 upward to the vacuum producing means 316. Because each of the walls 322 of the baffle structure are spaced inward of the outer side walls 324 of the enclosure 314, they define vacuum passages 332 that bracket the baffle enclosure aforedescribed. Each vacuum passage 332 is subject to the vacuum stream produced by the vacuum producing means 316, being in direct communication therewith. The lower end of each bracketing vacuum passage 332 is open in the same manner as is the lower end of the baffle structure such that air may be drawn into the enclosure 314 therethrough by the vacuum producing means 316.

Mounted on the outer surfaces of the outer walls 324 are ion generator means, each generally identified by the numeral 334. The ion generator means 334 are mounted within grounded shields which aid as safety enclosures 336 which extend for substantially the full length of the side walls 324 of the enclosure 314 to prevent any possible electrical shock or injury to anyone who may come into contact with the same. Each safety enclosure 336 is provided with an opening 338 at the lower portion thereof which enables the passage of a stream of ions from the generator means 334 and to permit the same to be directed at and onto the face of a surface 340 that is to be cleaned.

Mounted within the enclosure 314 is the previously mentioned rotary cleaner. The rotary cleaner 312 may be conveniently bearingly supported for rotation within the enclosure 314. It may be driven in any convenient manner by a motor (not shown) that may be mounted within or outside of the enclosure 314. The method of mounting such motor and the specific manner of bearingly supporting the rotary cleaner 312 form no specific part of this invention other than to note that such details may be conventional. The roary cleaner 312 comprises a rotor member 342 that may be elongated in length for rotation about its axis.

The length of the rotor member 342 will be substantially the length of the enclosure 314 and will be so positioned as to rotate with a portion thereof extending below the defines of the opening of the enclosure 314 so as to project therebeyond for cleaning engagement with the face of the surface 340. The rotor member 342 is provided with a plurality of substantially equally spaced grooves or slots 344 that extend along the length thereof. The grooves or slots 344 provide seats about the periphery of the rotor member 342 for the support of cleaning members.

Two sets of cleaning members are employed in the present invention disclosure. One of such cleaning members is in the form of an elongated brush, the bristles of which are sufficiently flexible to yield upon engagement and brushing contact with the surface 340. Such brush members are identified by the numeral 346 and it will be noted that they are substantially equally spaced about the periphery of the rotary member 342. However, alternately spaced between each such brush member 346 is a wiper member 348. Hence, it can be seen that the plurality of brush and wiper members 346 and 348 are each relatively and alternately spaced from the other about the periphery of the rotor member 342 and extend radially therefrom for cleaning engagement with the exposed area of the surface 340 to be cleaned thereby.

Each brush and wiper member is mounted within a respective holder 350 which is adapted to be wedged and fixedly mounted within its respective groove 344 defined about the periphery of the rotor member 342. The holder 350 can be easily removed from its respective groove 344 by prying the same loose therefrom and enabling a new holder member, having either a brush member 346 or a wiper member 348, inserted in the place of the old one. Thus, worn cleaning members 346 or 348 may be conveniently exchanged for new ones should the need require their replacement.

The brush and wiper members 346 and 348 each extend along the elongation of the rotor member 342. Each is flexible along their lengths to bend along their radial extents in response to their respective engagement with the face of the surface 340 to be cleaned thereby. The radial end of each brush member 346 is angled in the direction of rotation 352 of the rotor member 342 such that the leading face of each brush member is of lesser radial extent than the trailing edge of the same brush member. Referring to the drawing, it will be noted that the leading edge of each brushing member 346 is shorter in length extending in a radial direction away from the rotor member than is the trailing edge of the same brush member. Hence, the angled face 354 of each brush member 346 presents an area for brushing engagement with the exposed face portion of the surfaces 340 to be cleaned thereby. As illustrated in the drawing, it will be noted that the brush member 346 shown in engagement with the surface 340 flexes to bend along its radial extent in response to its engagement with the surface and thus its area of engagement with the surface 340 is enlarged and progressively increased until finally the rotor member 342 causes the brush 346 to pass beyond the surface 340.

The wiper members 348 may be formed of a smooth, soft, porous or non-porous type fabric, as felt, that is sufficiently flexible to yield upon engagement with the surface 340. As illustrated in the drawing, such wiper members 348 may be folded over upon themselves about the centerline 356 such that the ends thereof are held within the holder 350. The relatively soft, smooth nap of the wiper members wipe across the exposed portion of the surface 340 and because of the flexible nature of such wiper members, they bend along their radial extent and fully flex along their lengths to thereby present area engagement and wiping contact with the exposed face portion of the surface 340 to be cleaned thereby.

It will be noted from the drawing that each wiper member 348 is of a greater radial extent than is the alternately spaced brush member 346. Hence, it can be recognized by those skilled in the art during the rotation of the rotor member 342, at least one brush member 346 and one wiper member 348 always will be in cleaning engagement with the surface 340. It has been found in practice that this feature of structure is unusually helpful in the cleaning of the surface 340. The brush member breaks attracting that hold lint, dust and other foreign matter to the exposed portion of the surface 340. By increasing the area of engagement between the brush 346 as it bends during its engagement with the surface 340, a progressively larger area of frictional engagement between the brush and the surface 340 is provided and, thus, particles of foreign matter are more easily broken free of the surface 340.

The movement of the wiper member 348 following closely the brushing action of the member 346 wipes the surface 340 to clean the brushed foreign particles free of such surface because their molecular and electrostatic attraction was previously interrupted by the brushing action. During the wiping motion, the particles are then wiped off the surface 340. It is recognized that although the brushing engagement between the brush members 346 and the surface 340 do cause particles to be brushed free of such surface, the closely following wiping action of the wiping member 348 completely cleans all remaining foreign particles and matter from the surface 340 since their attraction to the surface has already been broken and interrupted by the brush member 346.

By providing wiper members that are longer or of greater radial extent than the brush members 346, it can be seen that at all times during the cleaning motion at least one brush member and one wiper member are simultaneously in contact with the exposed portion of the surface 340. As a matter of fact, during certain periods of rotation of the rotor member 342, at least two bracketing wiper members 348 are in contact with the surface 340 while the intermediate brush member also engages the same surface. Hence, the cleaning action that is afforded by the bracketing wiper members 348 and the intermediate brush member 346 produces an unusually clean surface as compared to that of a rotary member having a continuous uninterrupted rotary shaped brush surface.

To improve and enhance the cleaning function of the rotary cleaner 312, there is provided an adjustment mechanism generally identified by the numeral 358. The adjustment mechanism comprises a bracket 360 that may be mounted on a wall 324. The bracket 360 is guided for vertical movement along a key 362 mounted to any convenient non-movable surface. A threaded rod 364 may be mounted in a lower bracket 366 also secured to the wall 324. Adjustment nuts 368 are adjustable along the length of the rod 364 such that rotation of the nuts 368 downwardly along the extent of the rod 364 will cause the enclosure 314 to rise with respect to the surface 340 and thus raise the cleaning members 346 and 348 above the surface 340 to vary their brushing action. In like manner, upward adjustment of the nuts 368 along the rod 364 will cause a lowering of the enclosure 314 and a consequent lowering of the rotor member 342 with its attendant structure relative to the surface 340 to be cleaned thereby.

Mounted within the baffle enclosure is a support 370. The support 370 supports a further brushing member 372 that is of sufficient lengthwise extent to assure its engagement with each of the respective cleaning members 346 and 348 as the same rotate past the brush 372. During such rotative engagement, the brush 372 wipes free from the cleaning members 346 and 348 any dust, lint or other foreign particles that adhere to the same and are not removed therefrom by the vacuum stream produced by the vacuum producing means 316.

In operation, the adjustment mechanism 358 is adjusted to properly position the rotary cleaner 312 relative to the surface 340 to be cleaned thereby to provide for the proper pressure of cleaning engagement therebetween. As the surface 340 moves in the direction of the arrow 374, the rotary cleaner 312 is rotated in a counter direction as shown by the arrow 352 thereon. The bracketing ion generator means 334, being connected with a source of electrical energy (not shown), each produces a high voltage charge that releases a stream of ions to create a static neutralizing barrier both upstream and downstream of the surface 340 prior to and after its cleaning engagement with the rotary cleaner 312.

The upstream ion generator 334, namely, the right-hand generator, produces a stream of ions that subject the surface 340 to neutralizing electrical forces to overcome such electrostatic forces that tend to hold foreign particles to the surface 340 before the same moves beneath and into engagement with the rotary cleaner 312. Those foreign particles whose electrostatic charge is neutralized will immediately be sucked and vacuumed free of the face of the surface 340 before it moves under the brushing, wiping upstream curtain 317, drawing the particles into the passage 332 between the spaces in the curtain. As the surface 340 moves beneath the adjacent vacuum passage 332 which is within and forms a part of the vacuum stream produced by the means 316, it is distorted and lifted upward to conform to the arc described by the members 346 and 348 for fuller area engagement therewith. Hence, those particles that remain attracted to the surface 340 are then subjected to the successive brushing and wiping action of the cleaning members 346 and 348 of the rotary cleaner 312 to cause the same to be lifted free of the surface and to be subject thereafter to being drawn up the enclosure 314 by the vacuum producing means 316 into the receptacle 318.

Thereafter, as the surface 340 continues its movement beyond the rotary cleaner 312, it is again subjected to a final vacuuming stream at the left-hand bracketing vacuum passage 332 downstream of the rotary cleaner 312 and a final brushing and ionizing stream at the downstream curtain 317 and ionizer 334. This last vacuum, cleaning and neutralizing ionization of the surface 340 removes any minor particles of foreign matter that may remain loosely adhered to the surface 340.

In order to completely neutralize all electrostatic forces that may have been possibly produced by the engagement of the cleaner members 346 and 348 with the surface 340, such surface is then subjected to a final stream of neutralizing ions by the downstream ion generator 334 shown in the left-hand side of the drawing. Thus, it will be seen that the bracketing ion generators, the bracketing vacuum passages and the vacuum main stream produced about the rotary cleaner 312, all cooperate to produce a clean face on the surfaces 340. The specific details of the rotary cleaner 312 provide area engagement and brushing of the surface 340 as the same moves beneath the simultaneously rotating member 342. This area engagement overcomes any barrier engagement between the dust particles and the surface 340 and thereafter the dust particles are removed from the surface by a smoothing nap action of the wiper members 348.

Hence, the reduced pressure in housing 314 effects a pressure gradient across the continuous web. Air pressure on the outboard side of the web drives the same into a distortional configuration about a substantial perimetric area of the cylindrical locus defined by the tips or edges of brushes 346 and wipers 348. The air flow admitted or bled in by curtains 317 is given some degree of localization and isolation by baffles 322 and passages 332. This baffle arrangement effects a directional air flow about the brushes and wipers with which to capture the particulates for their transportation into duct 320.

Figure 4:
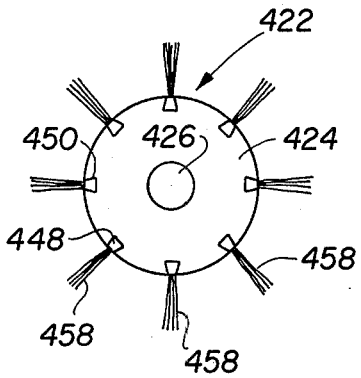
FIG. 4 is an elevational view, in section, of another brush having relatively spaced discrete bristle packets and the keyways for detachably retaining the bristle packets.

Turning to FIG. 4, there is shown another form of the abrasive means used in the present invention. Abrasive means 422 is comprised of an array of discrete brush-like packets 458 on drum 424. As was described with reference to FIG. 3, each packet is detachably fastened to drum 424 by having the root portion of the packets in the form of keys 448 and the associated drum part in the form of a complementary keyways 450. Operation of the embodiment of FIG. 4 remains essentially as previously described and so needs no further description here.

The composition and stiffness of bristles 28, brushes 346 and 348, and brush 422, will be chosen to accord with the texture and abrasive strength of the stock to be cleaned. Indeed, adjusting relative strength of the negative pressure will effect the amount and severity of engagement afforded by either positioning means 42 or 358 as these two adjustments interact. Thus, the strength or severity of the brushing action can be "tuned" to the abrasive strength and relative contamination of the feed stock.

While only a few embodiments of the present invention have been shown and described, it is to be understood that many changes and modifications can be made hereto without departing from the spirit and scope thereof.

What is claimed is:

1. A device to clean a moving surface comprising:

a housing beneath which the surface moves in spaced relation, cleaning means rotatable in said housing relative to the moving surface to contact and clean the same, skirt means on said housing and extending therefrom to engage and wipe the surface moving therebeneath before and after the same is cleaned by said cleaning means, ion discharge means operable to deposit the discharge thereof on the moving surfce at least before the same is engaged by said skirt means, and vacuum means coupled to said housing whereby on application thereof, the moving surface is drawn into said housing against said cleaning means causing the moving surface to distort along a substantial perimetric portion of and about said cleaning means to provide an increased period of a cleaning engagement between the moving surface and said cleaning means as said skirt means retains the moving surface spaced from said housing and the ambient environment so that material dislodged from the moving surface is collected in said vacuum means.

2. The device of claim 1, said cleaning means being rotatable in a direction opposite that of the moving surface.

3. The device of claim 2, said ion discharge means including another one of the same operable to deposit the discharge thereof on the moving surface after same contacts said cleaning means.

4. The device of claim 2, the length of said cleaning means being substantially coextensive with the width of the moving surface, said cleaning means having a circular periphery defined by an array of bristles.

5. The device of claim 2, baffle means in said housing and disposed part way around said cleaning means.

6. The device of claim 2, said cleaning means comprising discrete packets of alternately arranged and relatively spaced bristles and wiping means for respective and substantially concomitant brushing and wiping of the moving surface.

7. The device of claim 6, said bristle packets being radially disposed and their tips being disposed at an angle to their respective radii so that as the bristles brush the moving surface, they contact the same substantially along a plane.

8. In combination, a housing, brush means rotatable journalled in said housing and operable to contact a material moving in path relative thereto for cleaning thereby, a pair of flexible porous means carried on said housing in spaced relation to and fore and aft of said brush means to wipe the moving material before and after the same is cleaned by said brush means, corona discharge means operable to deposit electrical ions on the moving material at least before the same contacts said brush means, and vacuum source means in communication with said housing to draw the material out of its path of movement into arcuate contact with and part way about a substantial perimetric portion of said rotating brush means to increase the period of contact of said brush means with the moving material to clean the surface thereof in a negative pressure environment of said vacuum source partially isolated from ambient air pressure by said porous means.

9. The combination of claim 8, said brush means carried in said housing off center in relation to said housing to create a primary zone of cleaning anterior to the contact of the web material with said brush means and a secondary zone of cleaning posterior to the contact of the web material with said brush means.

10. The combination of claim 8, said corona discharge means being mounted on said housing beyond said porous means to deposit ions on the moving material before and after the same moves beneath said porous means.

11. The combination as in claim 10, said brush means having bristles extending radially about its periphery for at least the width of the moving material.

12. The combination as in claim 11, said bristles being arranged in packets each separated from the other about the periphery of said brush means.

13. The combination as in claim 10, said brush means having packets of alternately arranged and relatively angularly spaced packets of bristles and wipers each adapted for respective and substantially concomitant brushing and wiping engagement with the moving material.

14. A device for cleaning a moving surface comprising:

a housing extending for the width of the moving surface, a cleaner rotatable in said housing in a direction opposite the direction of the moving surface and defining spaced anterior and posterior cleaning zones on opposite sides thereof in said housing and extending for the width of the moving surface, means connected with said housing to subject the zones, cleaner and moving surface to a negative pressure, skirt means on said housing spaced fore and aft of said cleaner and defining the outer limits of said zones such that as the surface moves beneath said housing it is subjected to the negative pressure and is drawn into said zones and is thereby caused to conform about and into area cleaning engagement with said rotary cleaner, and means on said housing to apply a stream of ions to the moving surface prior to subjecting the same to said negative pressure.

15. A device as in claim 14, said cleaner having bristles about its periphery engaging with the moving surface.

16. A device as in claim 15, said bristles being arranged in packets each arcuately spaced from the other about the periphery of said rotatable cleaner.

17. A device as in claim 14, said cleaner having about the periphery thereof alternately arranged and relatively spaced bristles and wipers each respectively and substantially concomitantly brushing and wiping the moving surface.

* * * * *